US009648929B2

(12) United States Patent
Tew et al.

(10) Patent No.: US 9,648,929 B2
(45) Date of Patent: May 16, 2017

(54) INTERCHANGEABLE HOOP EARRING COVERS AND METHODS OF MAKING AND USING THE SAME

(71) Applicant: Spirit Hoops, Inc., Pinehurst, NC (US)

(72) Inventors: Arthur Henry Tew, Pinehurst, NC (US); Anna Carrington Tew, Pinehurst, NC (US); Joshua Richard Brown, N.W. Hickory, NC (US)

(73) Assignee: Spirit Hoops, Inc., Pinehurst, NC (US)

( * ) Notice: Subject to any disclaimer, the term of this patent is extended or adjusted under 35 U.S.C. 154(b) by 0 days.

(21) Appl. No.: 15/140,798

(22) Filed: Apr. 28, 2016

(65) Prior Publication Data

US 2016/0316867 A1 Nov. 3, 2016

Related U.S. Application Data

(60) Provisional application No. 62/154,816, filed on Apr. 30, 2015.

(51) Int. Cl.
*A44C 7/00* (2006.01)

(52) U.S. Cl.
CPC ..... *A44C 7/002* (2013.01)

(58) Field of Classification Search
CPC ..... A44C 25/001; A44C 7/00; A44C 7/002
USPC ..... 63/23, 33, 40, 12, 13
See application file for complete search history.

(56) References Cited

U.S. PATENT DOCUMENTS 1,600,633 A * 9/1926 Hildebrand ..... A45C 1/02 150/150
3,063,487 A * 11/1962 Mullin ..... A45C 1/02 150/150
5,184,481 A * 2/1993 Joseph ..... A44C 7/003 63/12
5,472,281 A * 12/1995 Phelps ..... A45C 11/24 150/150
8,225,626 B1 * 7/2012 Blau ..... G09F 3/005 40/586
9,089,192 B1 * 7/2015 Holst ..... A44C 5/0092
2014/0366249 A1 * 12/2014 West ..... A44C 3/001 2/244

OTHER PUBLICATIONS

Namoaj earrings, Etsy.com, listed Aug. 29, 2014.*
Wikihow methods.*
Wikihow comments.*

* cited by examiner

*Primary Examiner* — Emily Morgan
(74) *Attorney, Agent, or Firm* — NK Patent Law, PLLC

(57) ABSTRACT

The presently disclosed subject matter provides a system for the enhancement of the hoop portion of a hoop earring. Particularly, the disclosed system enables different and various design elements to be secured and optionally removed from hoop earrings. The disclosed earring assembly comprises an earring comprising a hoop member and a cover. The cover comprises a front face and a rear face attached to the front face, thereby defining a cavity for receiving the hoop member.

9 Claims, 24 Drawing Sheets

INTERCHANGEABLE HOOP EARRING COVERS AND METHODS OF MAKING AND USING THE SAME

CROSS-REFERENCE TO RELATED APPLICATION

This application claims the benefit of U.S. Provisional Patent Application No. 62/154,816, filed Apr. 30, 2015, the entire disclosure of which is hereby incorporated by reference.

FIELD OF THE INVENTION

The presently disclosed subject matter is directed to interchangeable hoop earring covers and methods of making and using the same.

BACKGROUND

Hoop earrings have been used throughout history in various cultures of the world. For example, hoop earrings of gold, silver, and bronze have been found in ancient graves in Crete, dating to about 2000 B.C. Today, hoop earrings are available in a variety of styles that include hoops of various sizes and thicknesses, as well as hoops enhanced by the addition of one or more elements set in the outer surface of hoop. There are also styles of hoop earrings that include various attachments that hang from the bottom of the hoop to dangle below the earring. However, the hoop earring has remained basically an empty hoop, and no effective way has been found to add interest and beauty to the center of the hoop earring. It would therefore be beneficial to provide an earring assembly comprising selectively interchangeable covers to adorn the hoop portion of a hoop earring.

SUMMARY

In some embodiments, the presently disclosed subject matter is directed to an earring assembly comprising an earring that includes a hoop member. The assembly further comprises a cover comprising (i) a front face, (ii) a rear face attached to the front face, wherein the front and rear faces define a cavity for receiving the hoop member and (iii) an opening to the cavity. The cover is sized and shaped to span the hoop member such that the cover fits over the hoop member.

In some embodiments, the presently disclosed subject matter is directed to a cover for a hoop earring comprising a hoop member. The cover comprises a front face, a rear face attached to the front face, wherein the front and rear faces define a cavity for receiving the hoop member, and an opening to the cavity. The cover is sized and shaped to span the hoop member.

DETAILED DESCRIPTION

The presently disclosed subject matter provides a system for the enhancement of the hoop member of a hoop earring. Particularly, the disclosed system enables different and various design elements to be secured and optionally removed from hoop earrings.

Figure 1B:
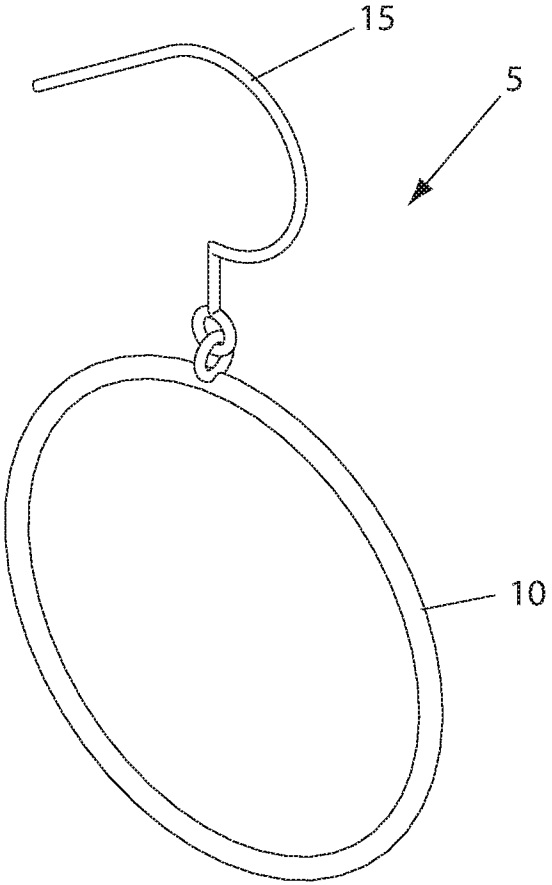
FIG. 1*b* is a perspective view of the earring of FIG. 1*a*.
Figure 1A:
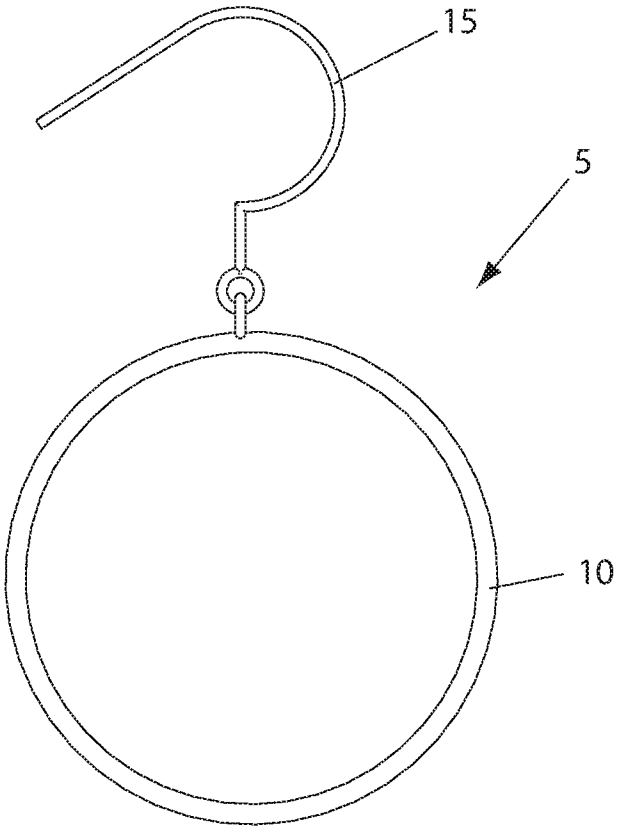
FIG. 1*a* is a top plan view of a hoop earring in accordance with some embodiments of the presently disclosed subject matter.

FIGS. 1*a* and 1*b* illustrate one embodiment of a hoop earring that can be used in accordance with the presently disclosed subject matter. Particularly, as shown in FIGS. 1*a* and 1*b*, earring 5 includes hoop member 10 connected to fastening element 15 that allows the earring to attach to the earlobe of the wearer. Fastening element 15 can include a hook, post, and the like for insertion into the channel of a pierced earlobe and/or can include a clip-on feature to accommodate non-pierced ears.

It should be understood that the term "hoop earring" includes earrings with hoop members of various shapes, including (but not limited to) circles, ovals, squares, rectangles, triangles, stars, diamonds, pentagons, hexagons, octagons, hearts, teardrops, hearts, crescents, clovers, abstract designs, or other shapes as suitable for the user. Thus, the term "hoop" as used herein is not limited to circular designs, and can include any design with a fully or partially closed structure. Suitable hoop earrings can be constructed from any of the wide variety of materials known and used in the art, including (but not limited to) metal, wood, plastic, and the like. Suitable hoop earrings can be of any general size and are thus not limited.

Figure 2B:
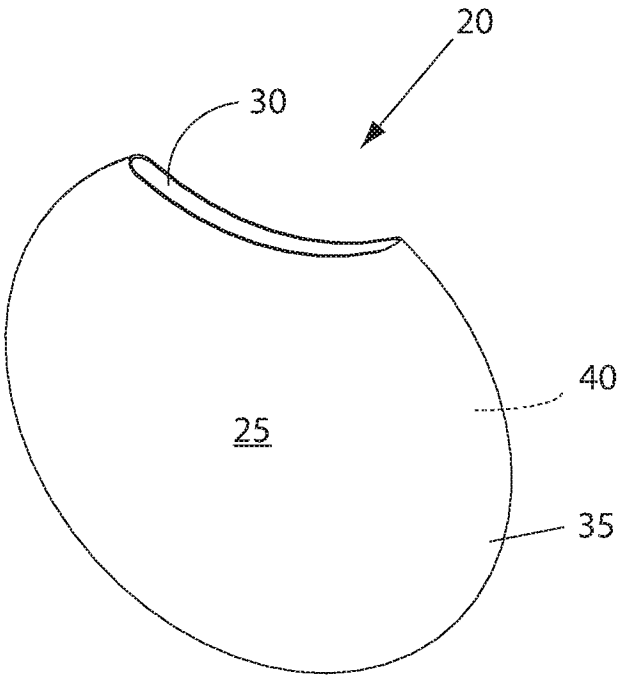
FIG. 2*b* is a perspective view of the cover of FIG. 2*a*.
Figure 2A:
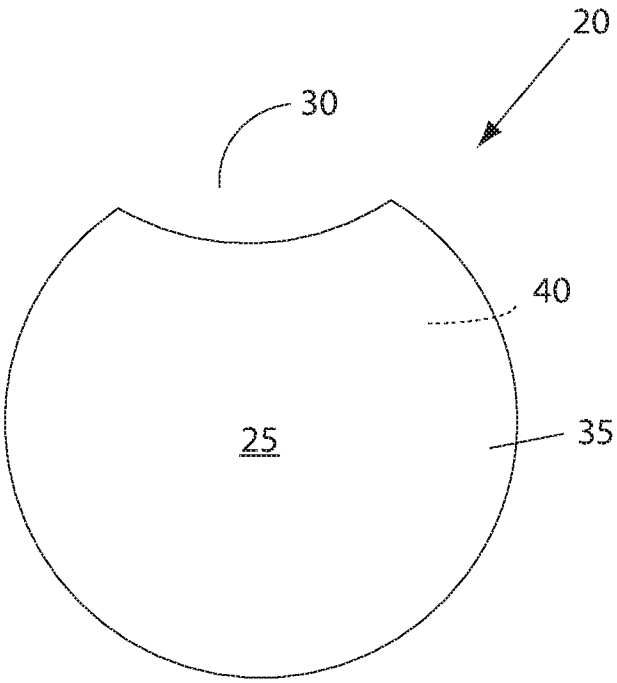
FIG. 2*a* is a top plan view of a cover in accordance with some embodiments of the presently disclosed subject matter.
Figure 3B:
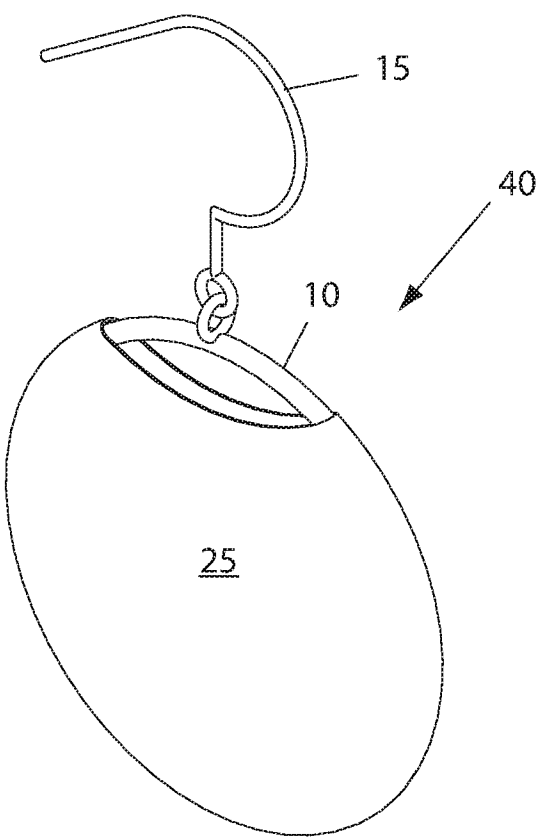
FIGS. 3*b* and 4*b* are perspective views of the assemblies of FIGS. 3*a* and 4*b*, respectively.
Figure 3A:
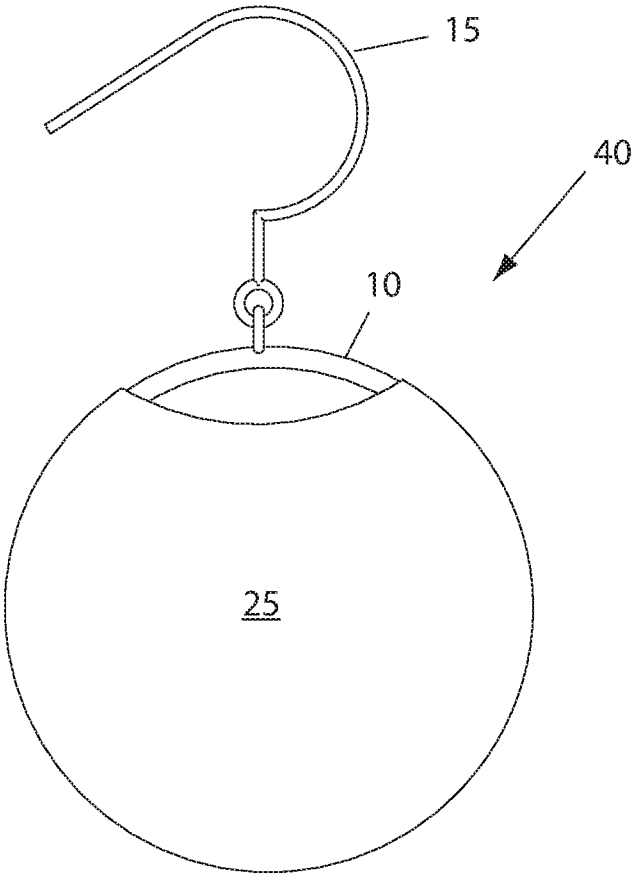
FIGS. 3*a* and 4*a* are top plan views of earring cover assemblies in accordance with some embodiments of the presently disclosed subject matter.
Figure 4B:
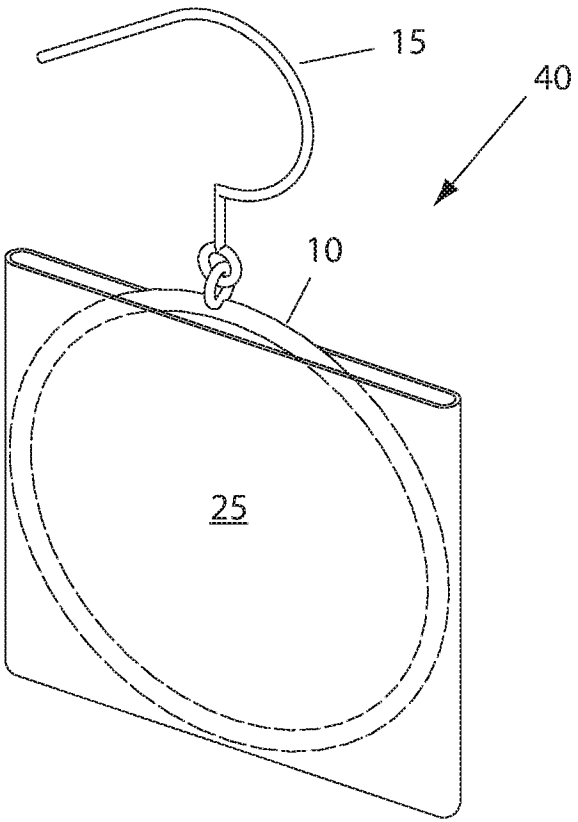
Figure 4A:
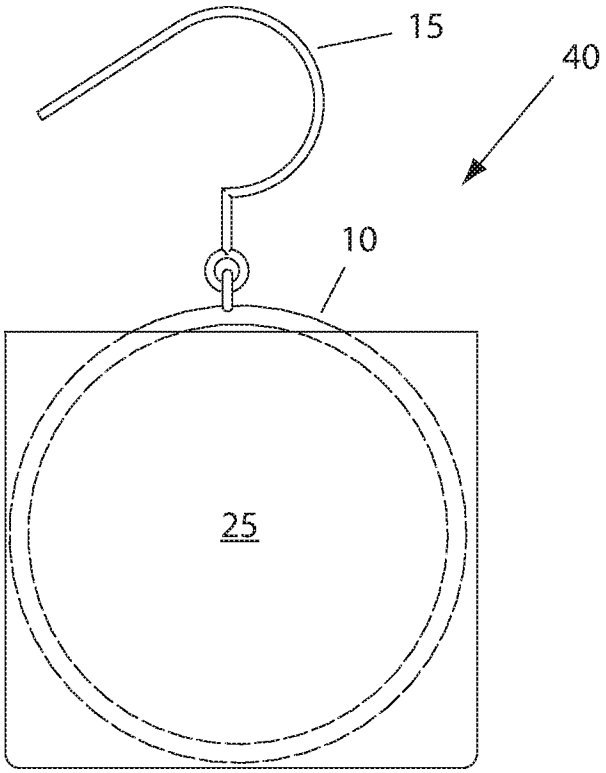
Figure 5B:
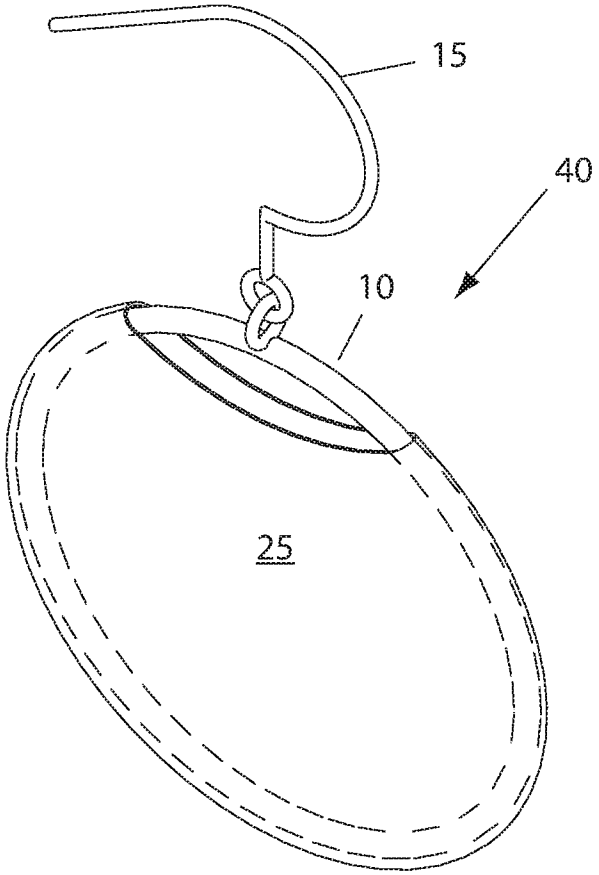
FIGS. 5*b*, 6*b*, 7*b*, 8*b*, 9*b*, 10*b*, 11*b*, 12*b*, 13*b*, 14*b*, 15*b*, 16*b*, 17*b*, 18*b*, 19*b*, 20*b*, 21*b*, 22*b*, 23*b*, and 24*b* are perspective views of the embodiments illustrated in FIGS. 5*a*, 6*a*, 7*a*, 8*a*, 9*a*, 10*a*, 11*a*, 12*a*, 13*a*, 14*a*, 15*a*, 16*a*, 17*a*, 18*a*, 19*a*, 20*a*, 21*a*, 22*a*, 23*a*, and 24*a*, respectively.
Figure 5A:
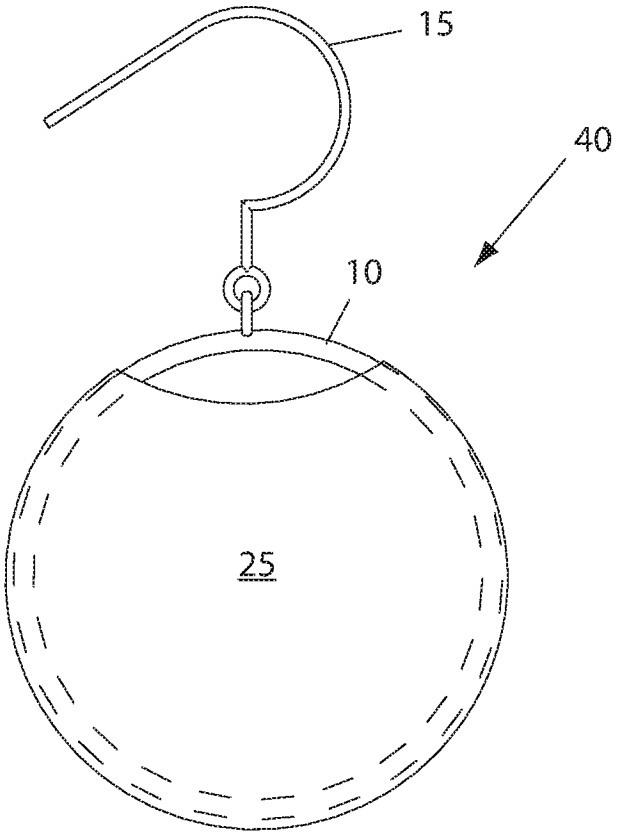
FIGS. 5*a*, 6*a*, 7*a*, 8*a*, 9*a*, 10*a*, 11*a*, 12*a*, 13*a*, 14*a*, 15*a*, 16*a*, 17*a*, 18*a*, 19*a*, 20*a*, 21*a*, 22*a*, 23*a*, and 24*a* are top plan views of several embodiments of an earring in accordance with the presently disclosed subject matter.
Figure 6B:
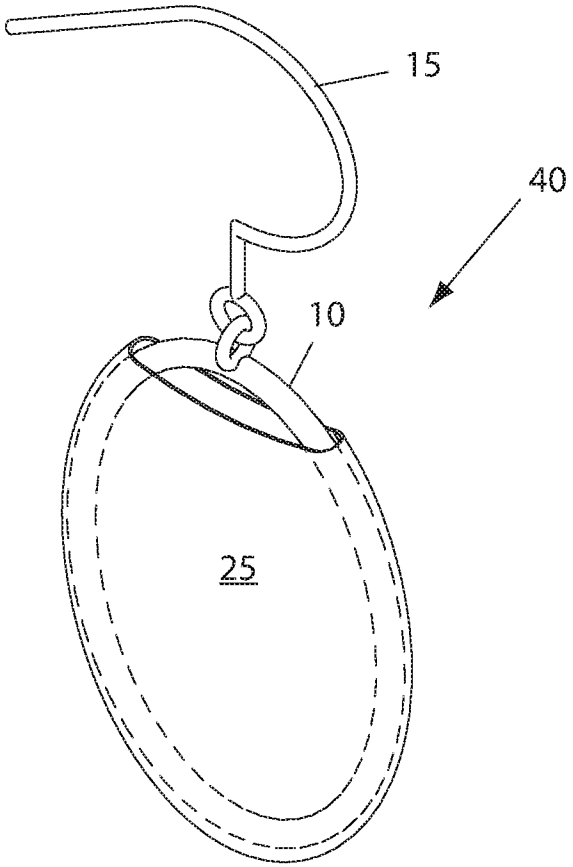
Figure 6A:
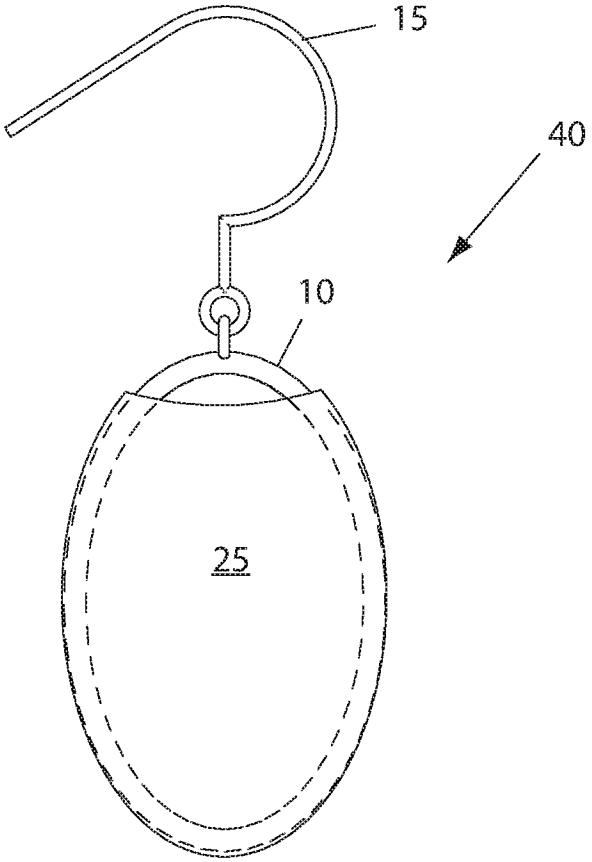
Figure 7B:
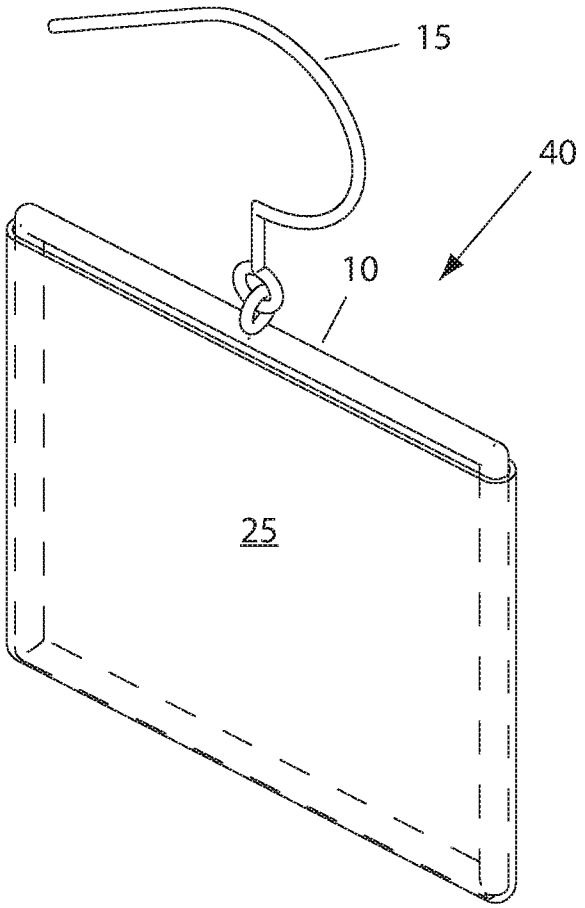
Figure 7A:
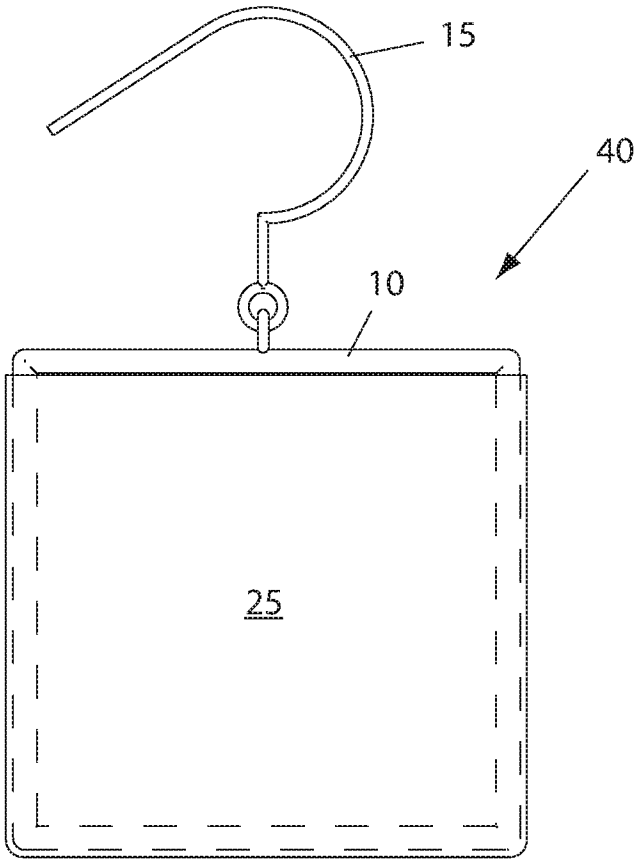
Figure 8B:
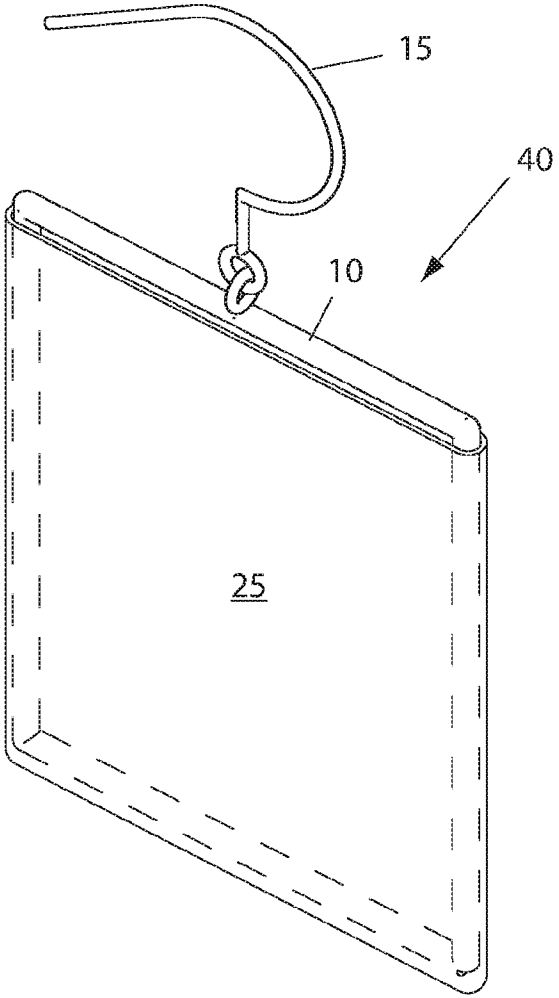
Figure 8A:
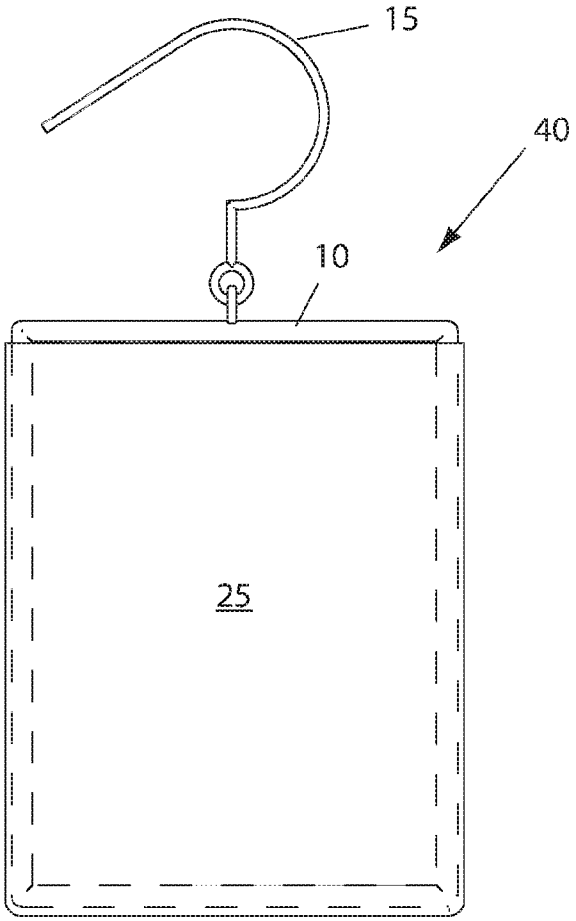
Figure 9B:
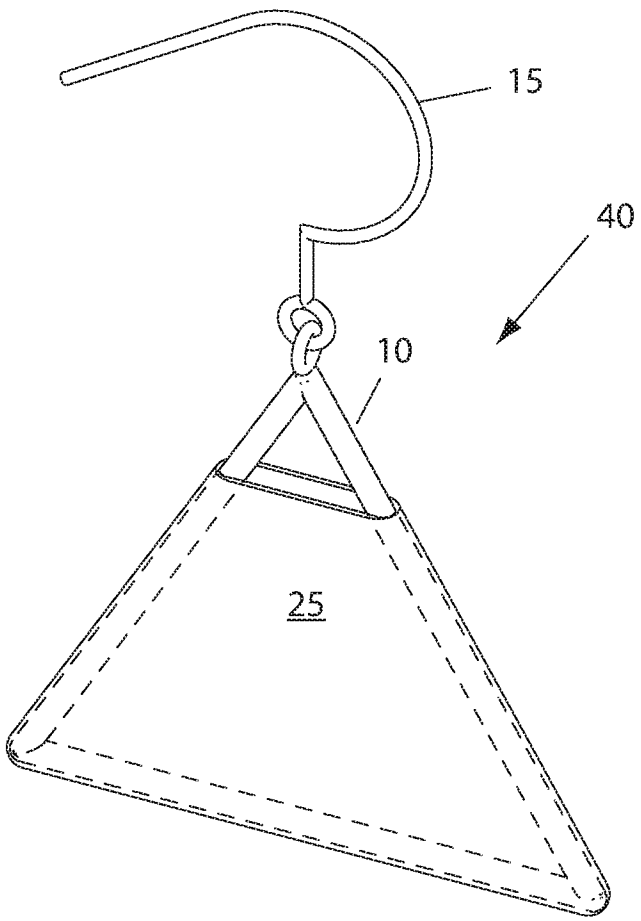
Figure 9A:
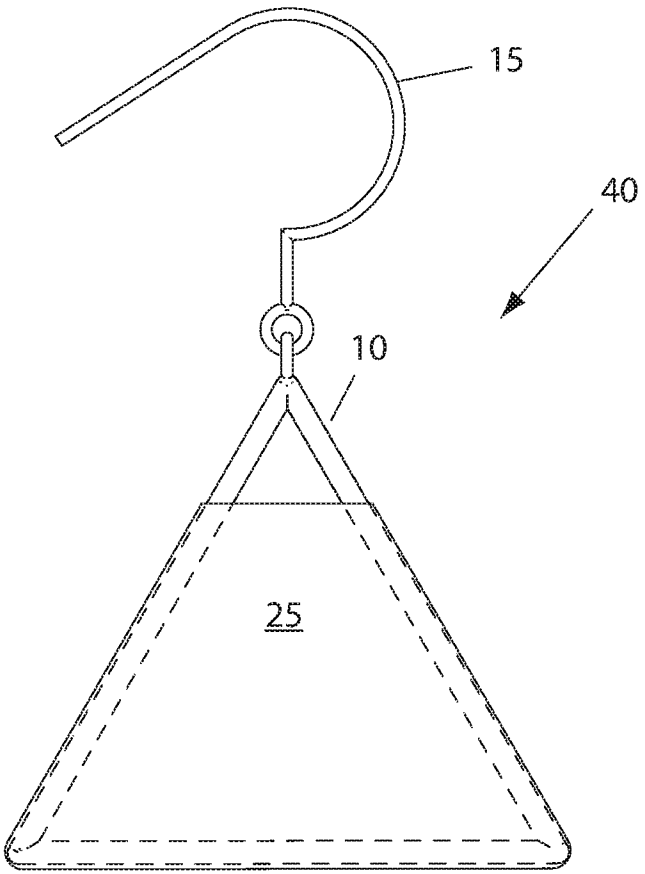
Figure 10B:
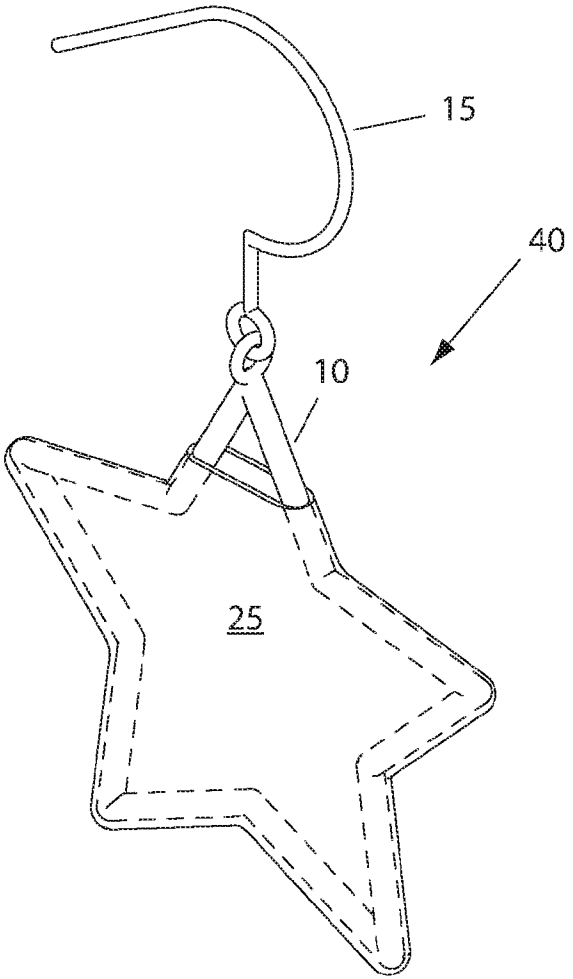
Figure 10A:
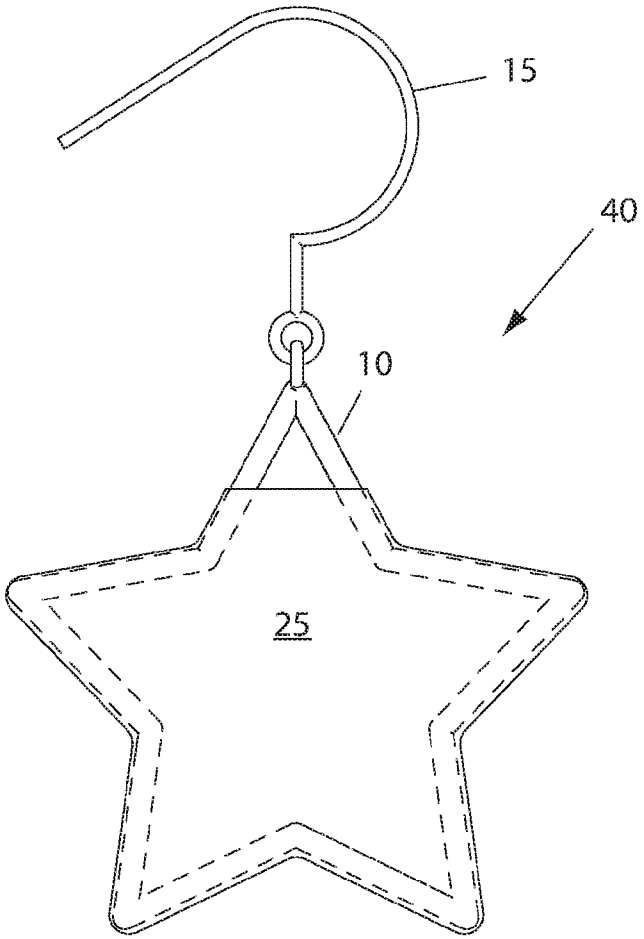
Figure 11B:
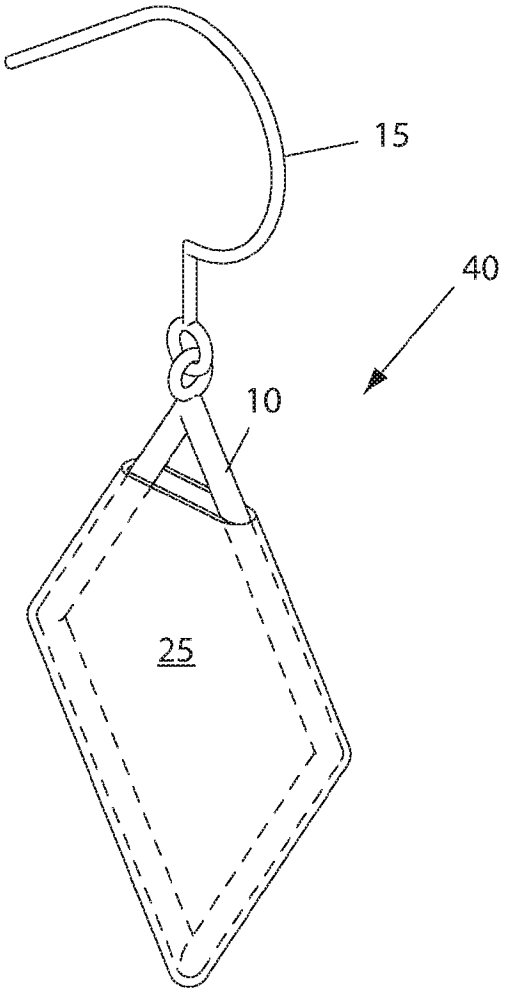
Figure 11A:
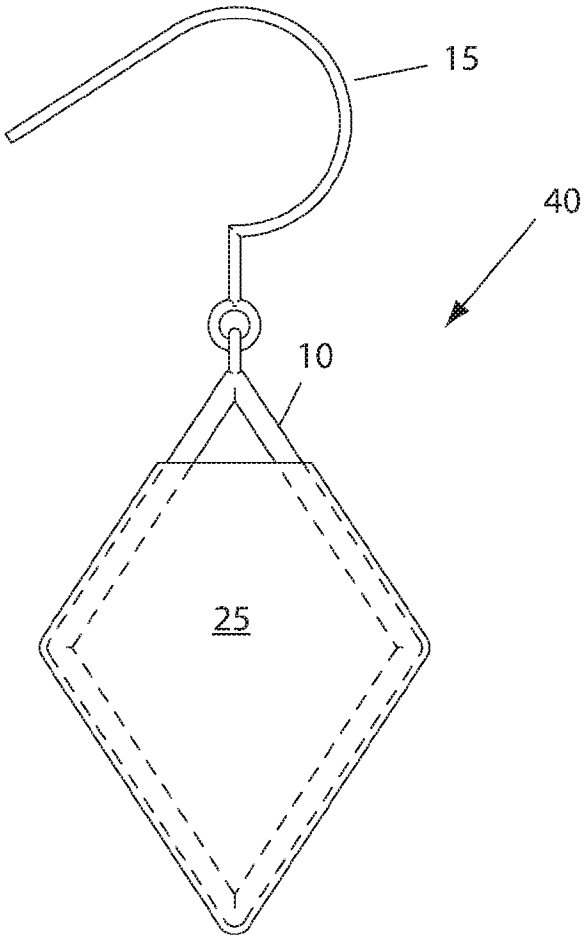
Figure 12B:
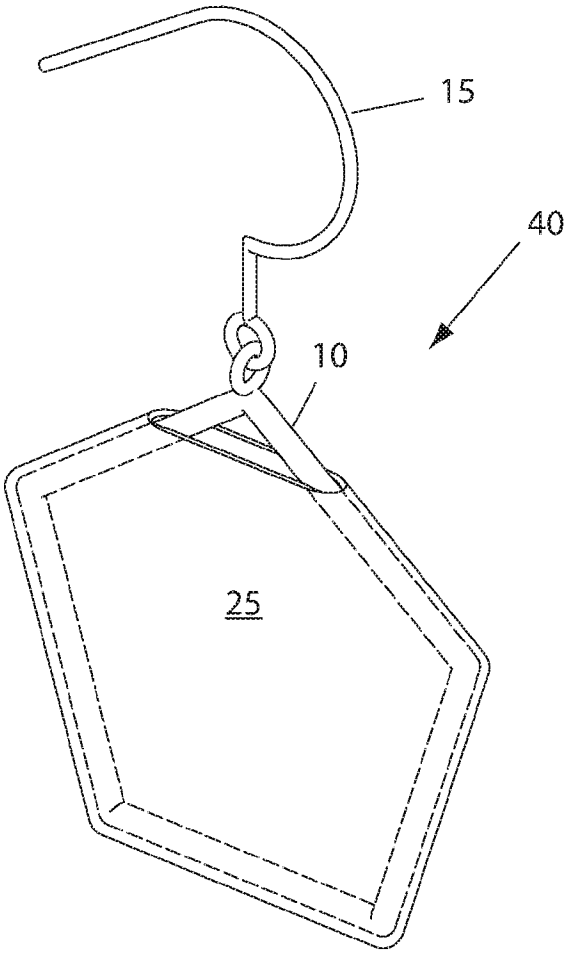
Figure 12A:
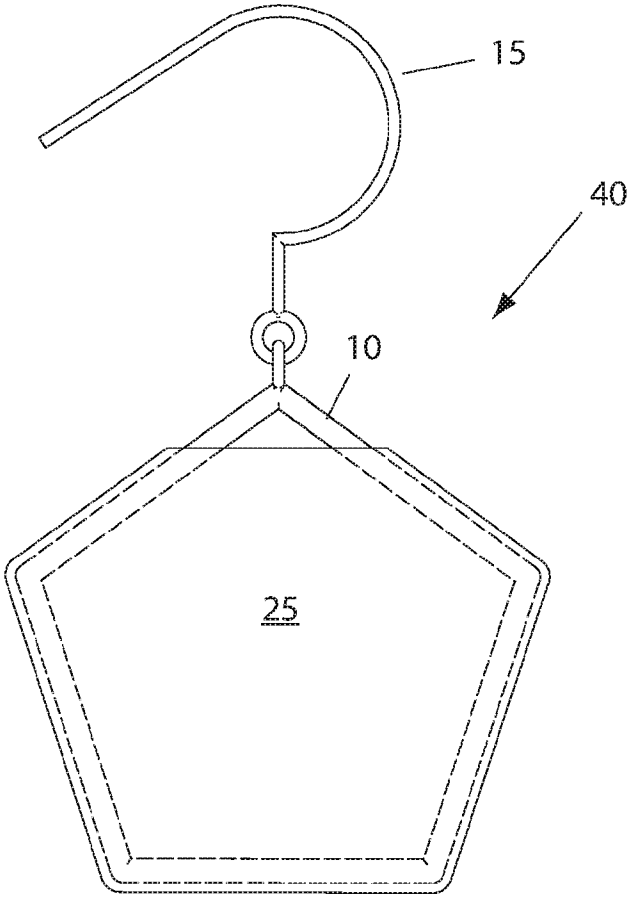
Figure 13B:
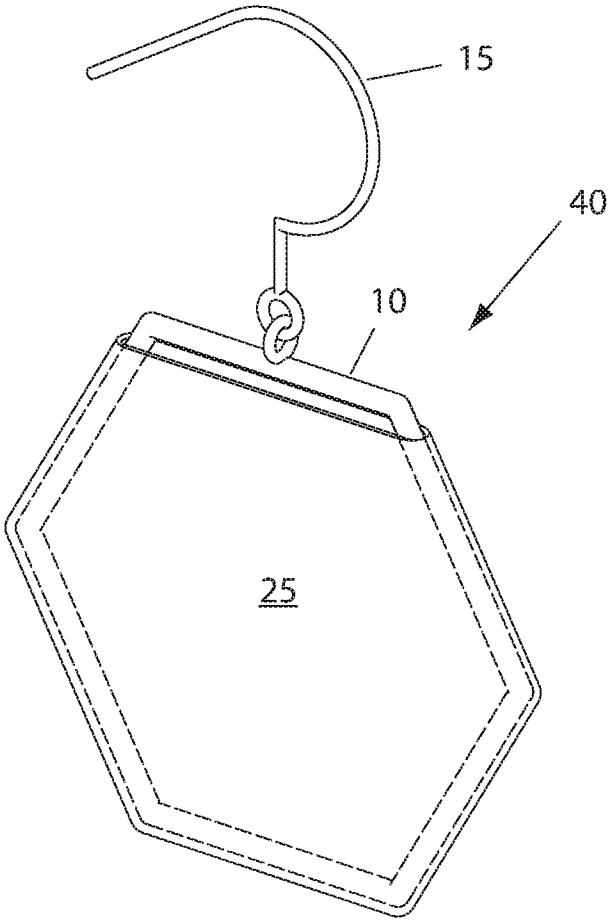
Figure 13A:
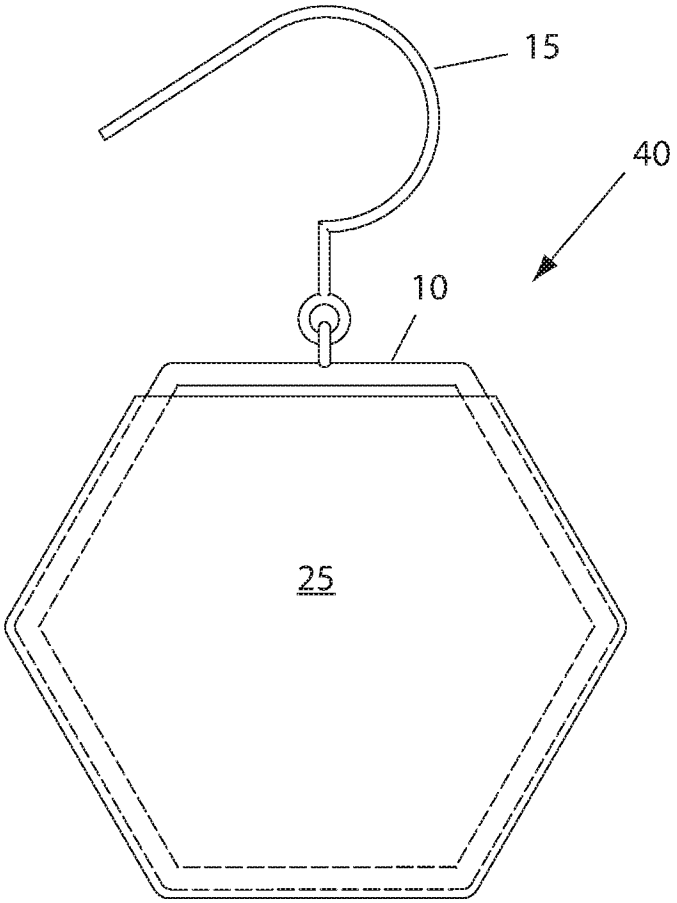
Figure 14B:
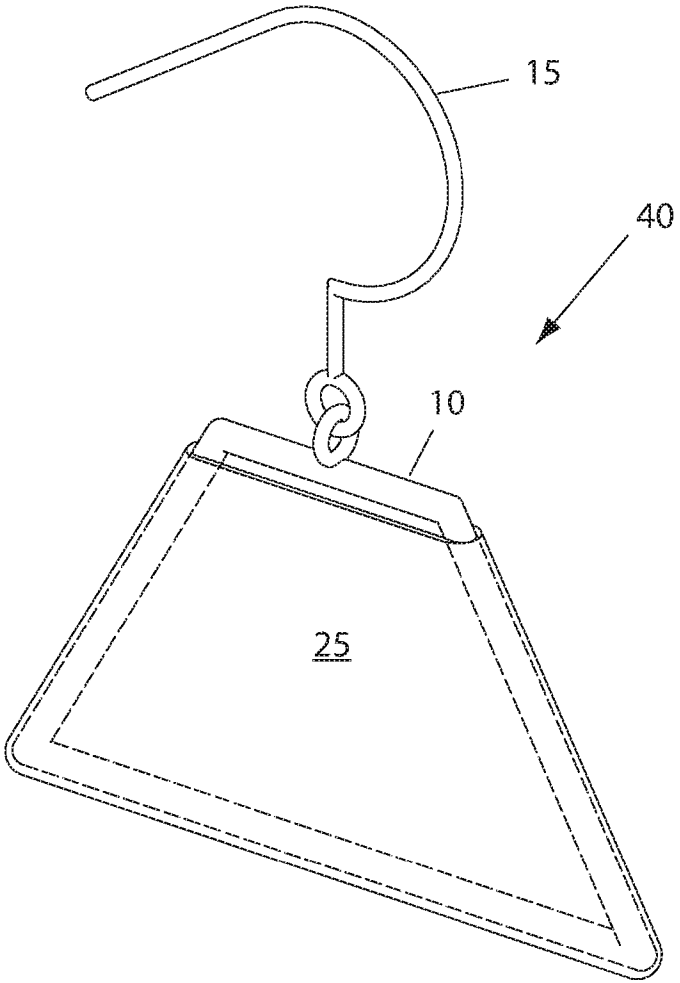
Figure 14A:
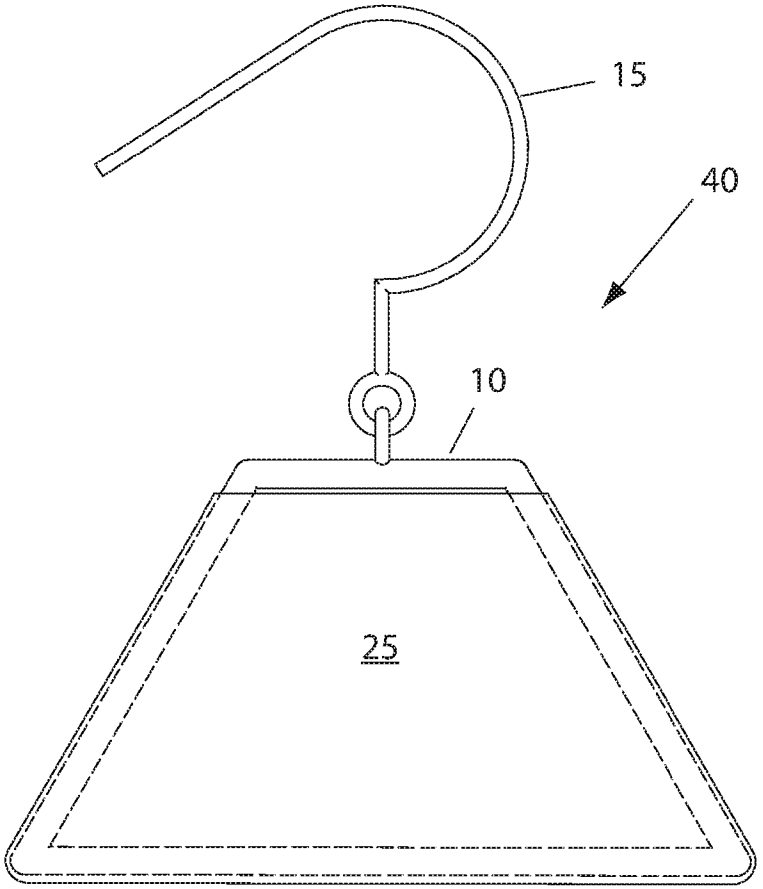
Figure 15B:
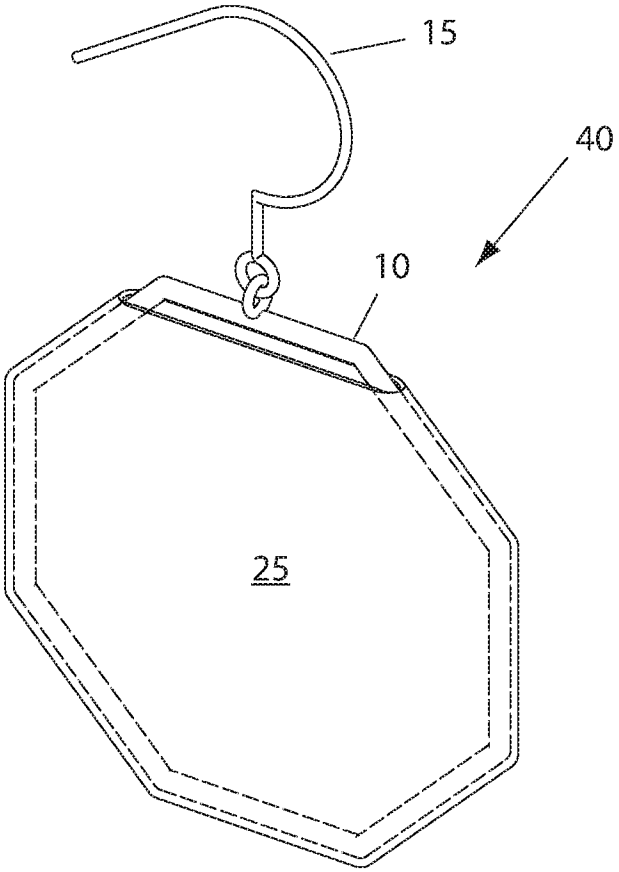
Figure 15A:
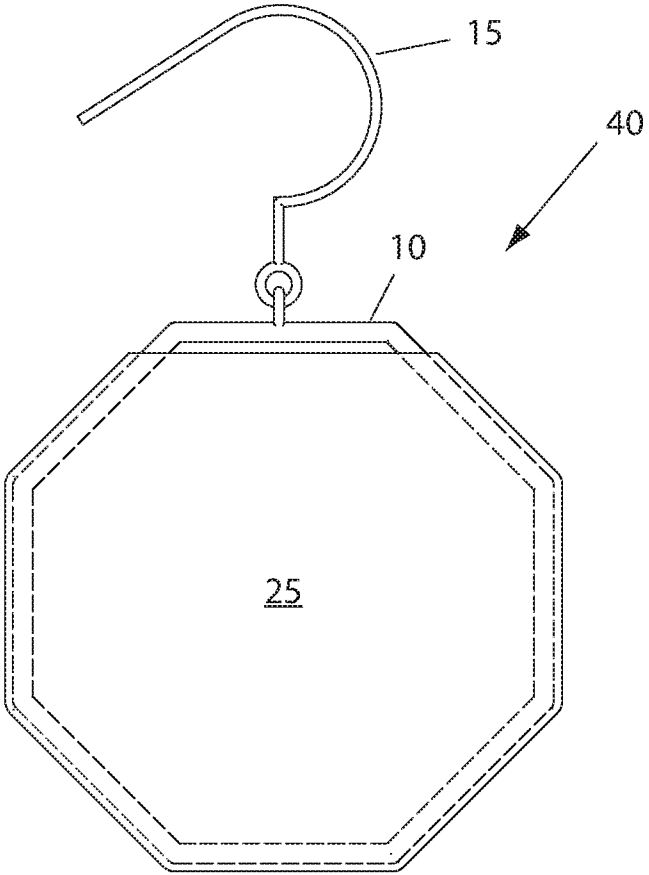
Figure 16B:
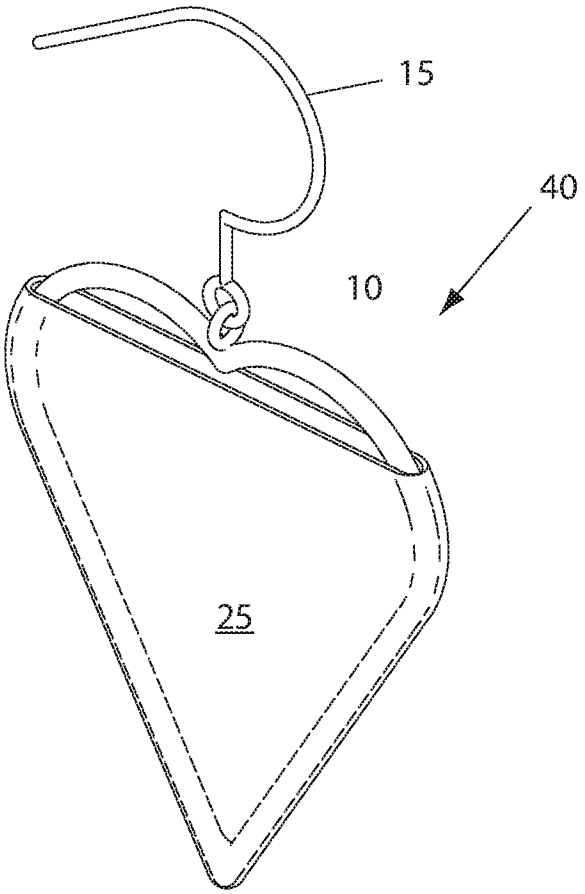
Figure 16A:
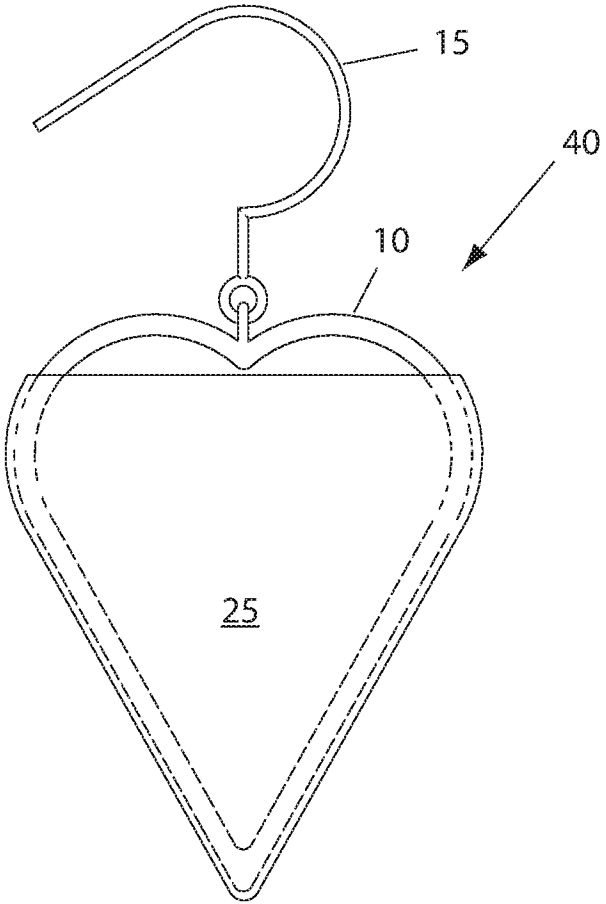
Figure 17B:
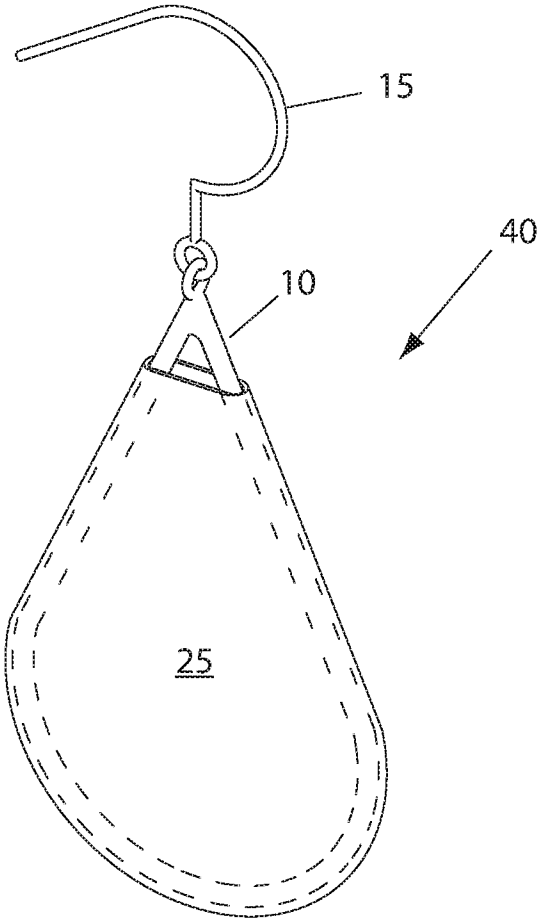
Figure 17A:
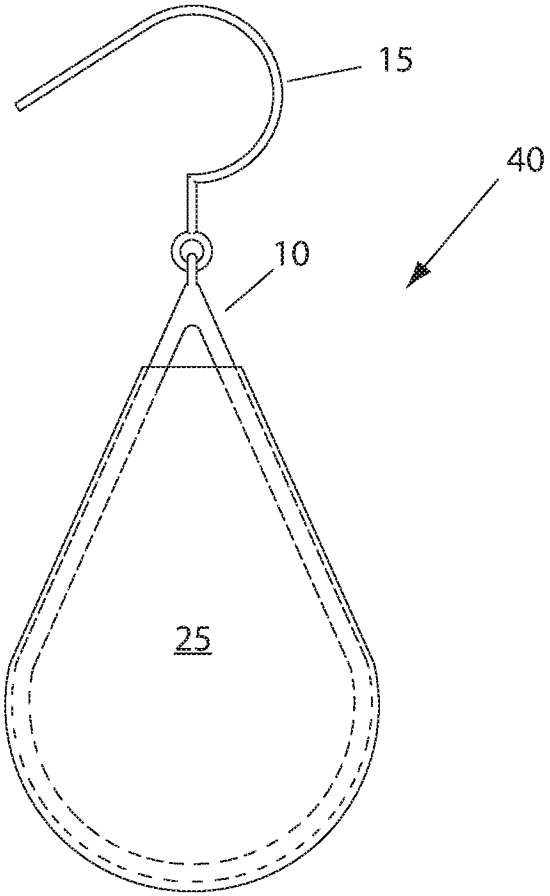
Figure 18B:
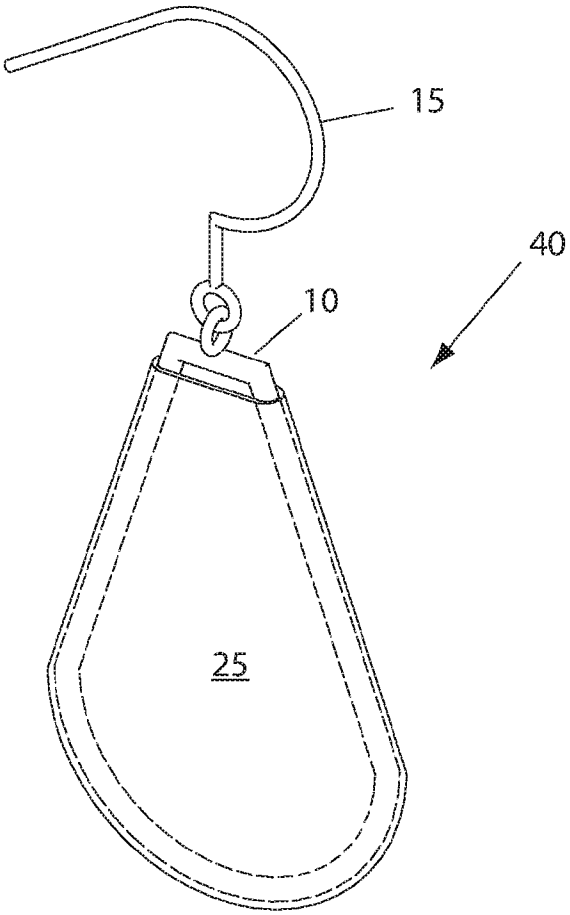
Figure 18A:
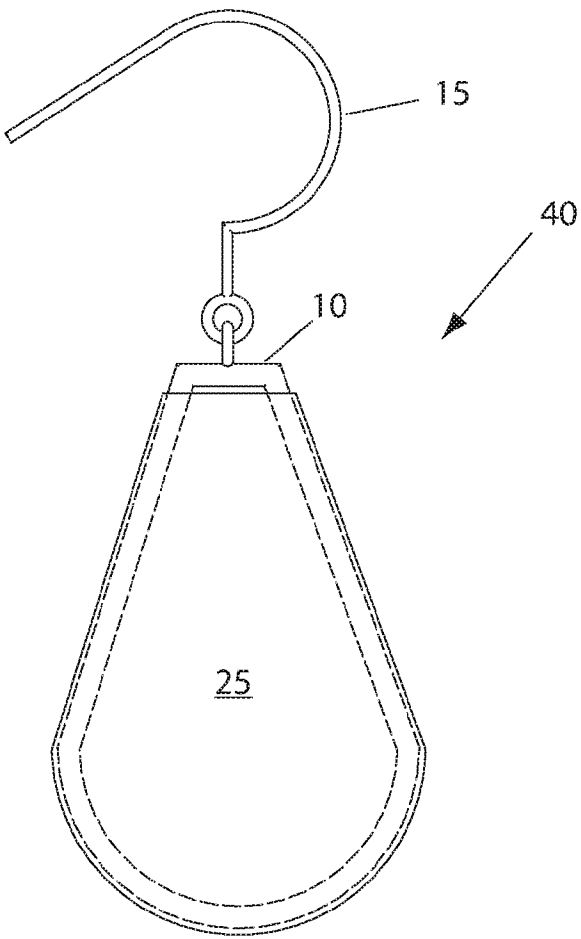
Figure 19B:
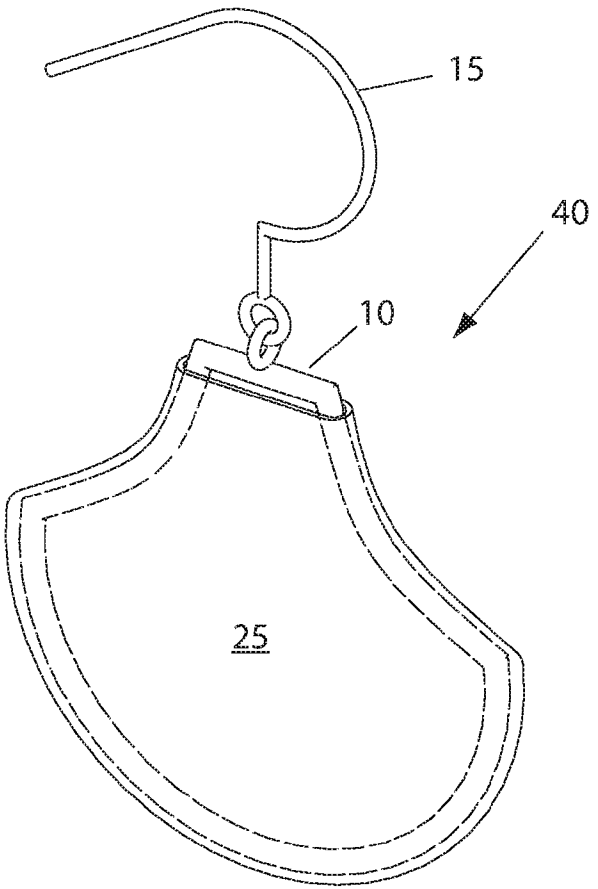
Figure 19A:
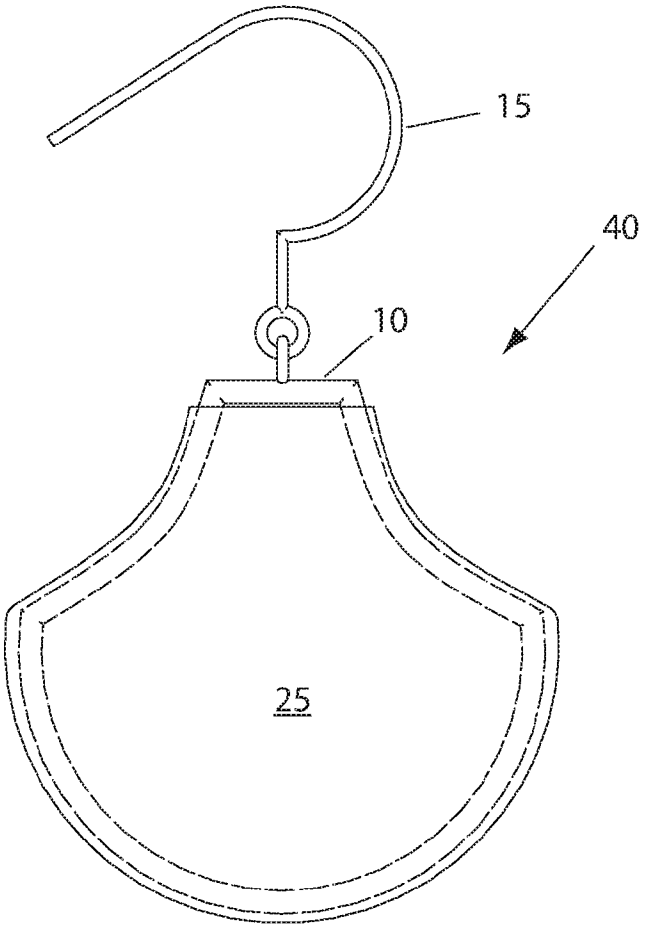
Figure 20B:
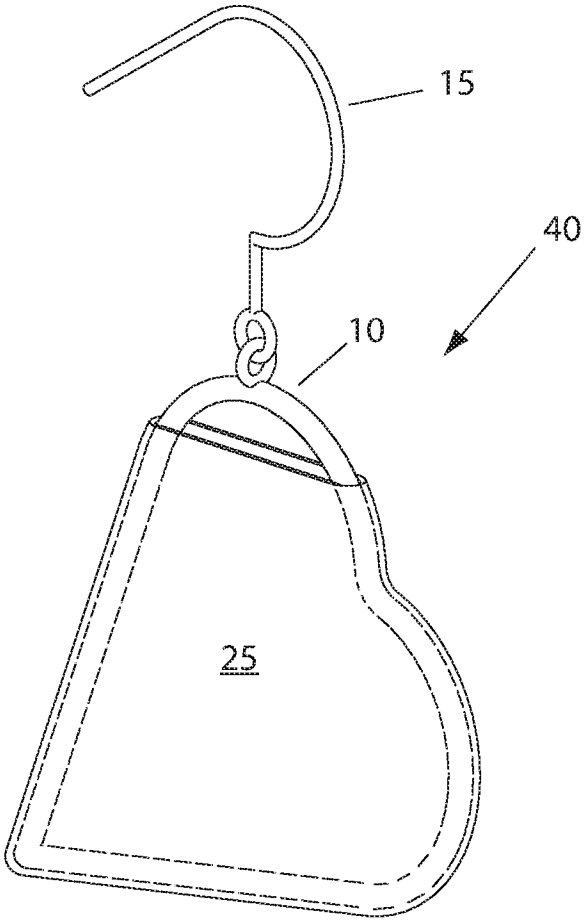
Figure 20A:
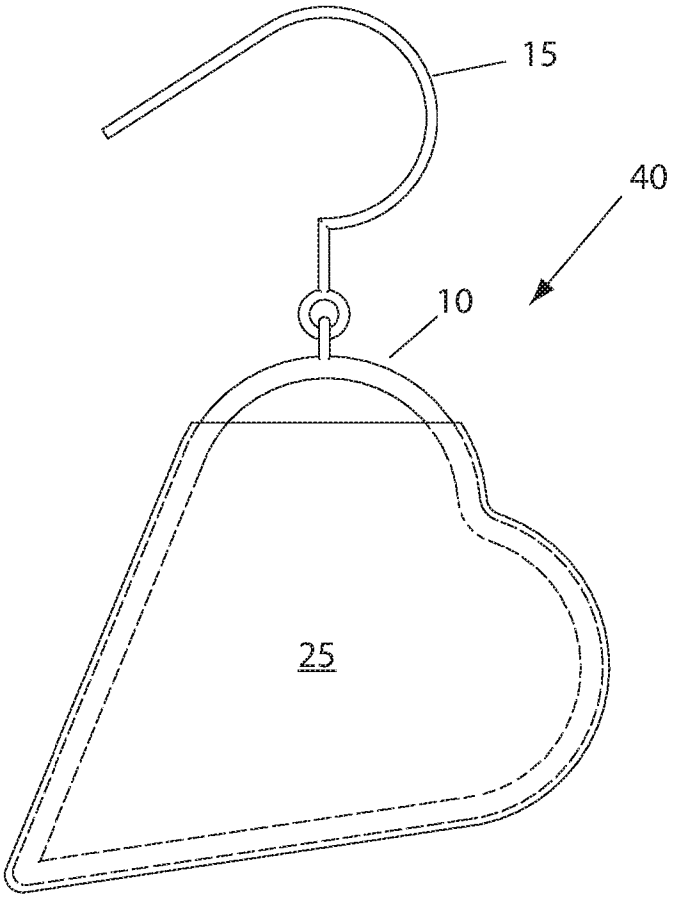
Figure 21B:
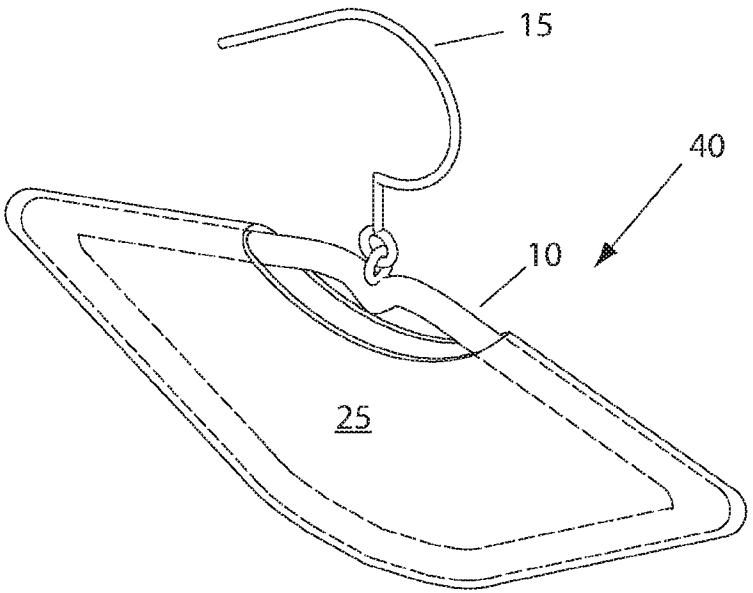
Figure 21A:
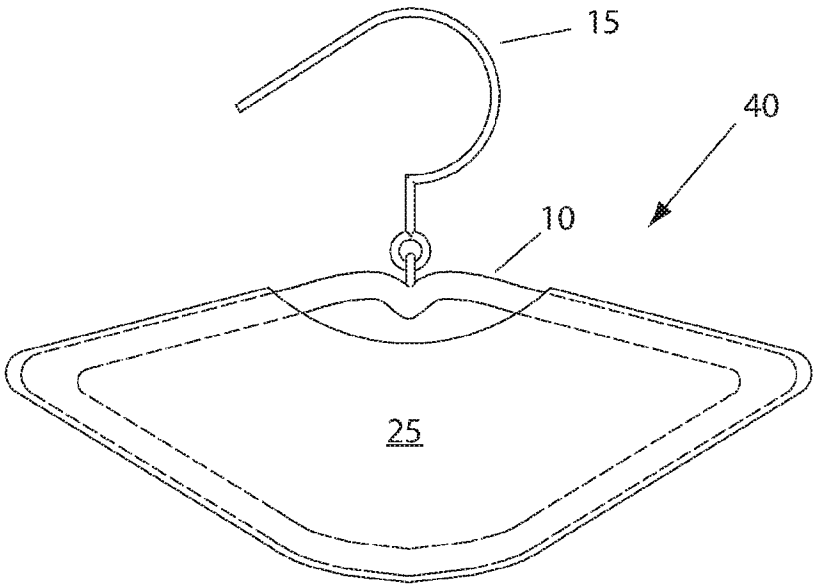
Figure 22B:
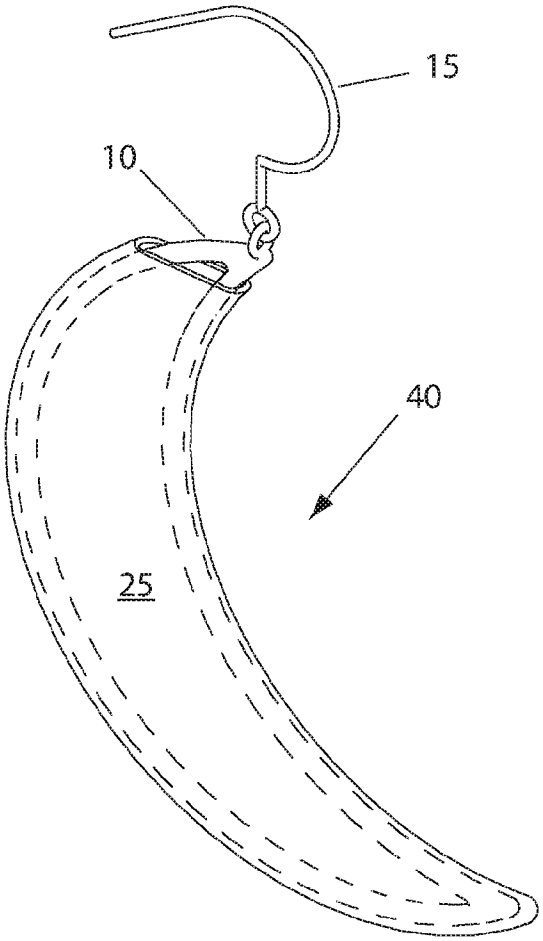
Figure 22A:
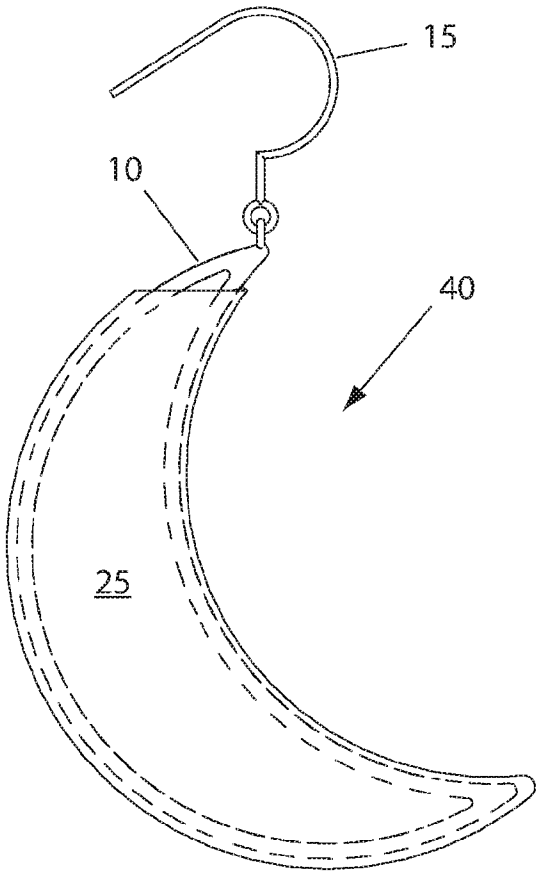
Figure 23B:
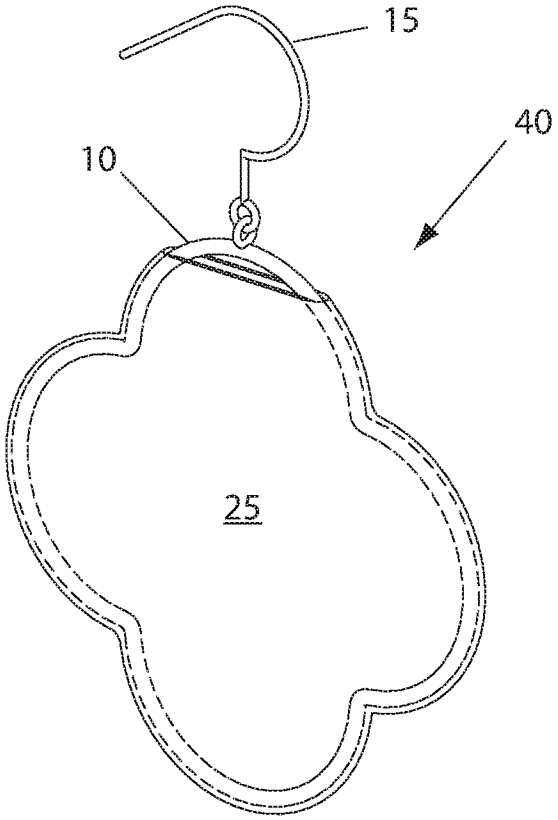
Figure 23A:
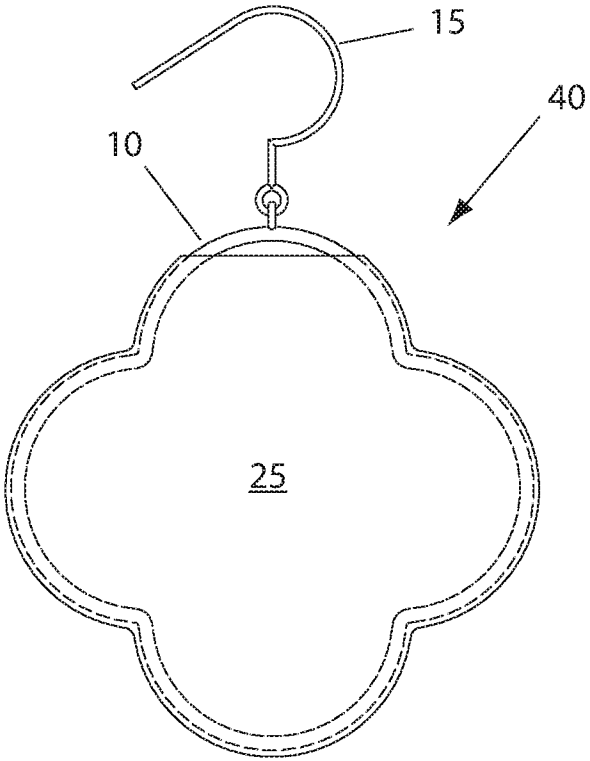
Figure 24B:
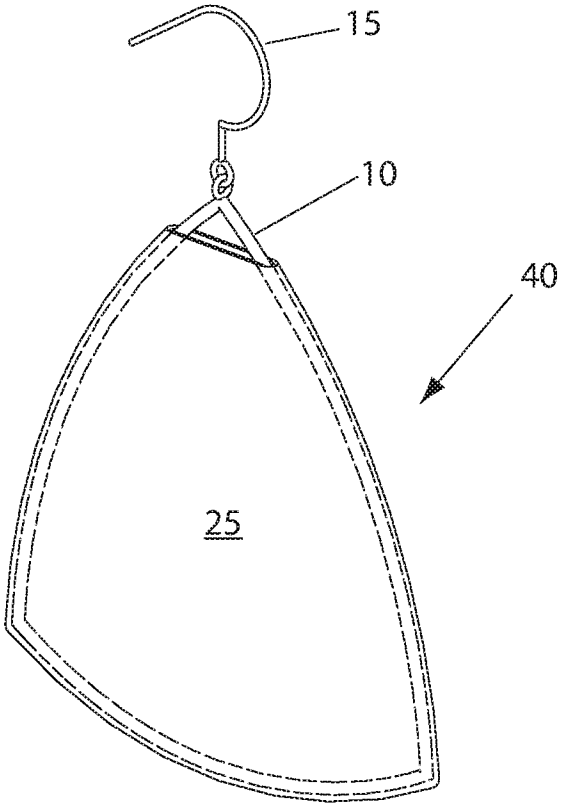
Figure 24A:
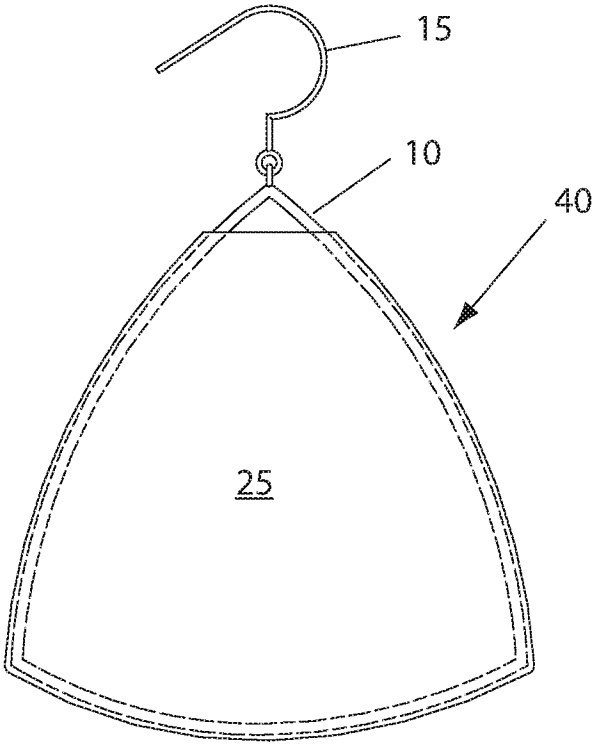

FIGS. 2*a* and 2*b* illustrate one embodiment of cover 20 that can be used with a hoop earring. Particularly, cover 20 comprises front face 35 and opposing rear face 40 that define a cavity for receiving the hoop member. Cover 20 also includes opening 30 that enables the cover to be slipped over hoop member 10. In some embodiments, the opening is defined by a peripheral edge of the cover front and rear faces. In some embodiments, opening 30 can be in any known shape, such as (but not limited to) circular, diamond, abstract, and the like. In some embodiments, the middle portion of the cavity can be larger in diameter than the top or bottom end portions and/or opening 30 to ensure that the cover does not become dislodged from the earring, except when desired by a user. Thus, cover 20 can be of generally the same shape as earring hoop member 10 and can be sized such that it fits over the widest part of hoop member 10. Alternatively, in some embodiments, cover 20 and hoop member 10 can be shaped differently, i.e., a circular hoop member fitted with a star-shaped cover.

Cover 20 can be constructed from any of the wide variety of materials known and used in the art, such as (but not limited to) cloth, rubber, plastic, and the like. In some embodiments, the material used to construct cover 20 can include an elastic material to allow it to stretch over the widest part of hoop 10. In some embodiments, cover 20 can be constructed from a lightweight material, such that it can be worn comfortably by the user. In some embodiments, cover 20 can be constructed from a material that facilitates grasping between two fingers for ease of use and manipulation. In some embodiments, the cover can be constructed from a single piece of material folded to create the front and rear faces. Alternatively, the cover can be constructed from two or more pieces of material such that front and rear faces 35, 40 are connected using any of the wide variety of methods known and used in the art, such as (but not limited to) adhesives, complementary threading, Velcro®, mechanical closures (hooks, snaps, buttons), and the like.

In some embodiments, the cover can be constructed using a fabric bonding method wherein an adhesive layer is adhered to a first sheet of fabric, a second sheet of fabric is then adhered to the second side of the adhesive layer and bonded using a heat press cycle. The cover can then be cut into a desired shape using a laser or die. However, it should be appreciated that the presently disclosed subject matter is not limited, and cover 20 can be constructed using any method known and used in the art.

In some embodiments, the cover front and/or rear faces can include writing or other designs, adornments, embellishments, and the like. For example, in some embodiments, team logos and colors can be imprinted on surface 25 of the front and rear faces of the cover, allowing others to see the logos, etc. In some embodiments, front and rear faces 35, 40 can comprise the same enhancements or different enhancements. As used herein, the term "enhancements" refers to the wide variety of adornments known and used in the art, including (but not limited to) bows, sequins, glitter, beading, fabric trim, lace, fabric (felt, chiffon, organza, sisal, and the like), photographs, flowers, faux jewels, real jewels, ribbons, buttons, zippers, chains, tassels, pins, embroidery, and the like. The design variations allow the wearer to utilize the earring assembly to create customized earrings with varied appearance.

To place the cover in position on earring 5, the user positions or stretches the cover opening to slide the cover body over the hoop member such that it is at least partially housed in the cavity. Thus, cover 20 releasably attaches to hoop member 10 by sliding opening 30 over the hoop member until it is adjacent to or past the widest portion of the hoop member, as shown in assembly 40 of FIGS. 3*a*-4*b*. As a result, cover 20 is maintained on hoop member 10 for a desired amount of time, i.e., until a user desires to remove the cover. To remove the cover, the user simply reverses the process, stretching or positioning cover opening 30 to slide in a direction away from the fastening element, thereby removing the hoop member from the cavity. Thus, cover 20 is easily attached and removed such that a plurality of covers can be interchangeably fitted to hoop member 10 of earring 5.

FIGS. 5*a*-24*b* illustrate various embodiments of the presently disclosed subject matter.

As will be realized, the presently disclosed subject matter is capable of other and different embodiments and its several details may be capable of modifications in various respects, all without departing from the disclosed scope. Accordingly, the drawings and description are to be regarded as illustrative in nature and not in a restrictive or limiting sense with the scope of the application being indicated in the claims.

What is claimed is:

1. An earring assembly comprising:

a. an earring comprising a hoop member; and b. a removable cover comprising:

i. a front face;

ii. a rear face attached to the front face, wherein the front and rear faces define a cavity for receiving the hoop member; and iii. an opening to the cavity;

wherein the cover is sized and shaped to span the hoop member such that the cover fits over the hoop member; and wherein the cover has a shape that is maintained before and after fitting over the hoop member.

2. The assembly of claim 1, wherein the hoop member is selected from one or more of the following shapes: circle, oval, square, rectangle, triangle, star, diamond, pentagon, hexagon, octagon, heart, teardrop, crescent, clover, or abstract design.

3. The assembly of claim 1, wherein the cover is selected from one or more of the following shapes: circle, oval, square, rectangle, triangle, star, diamond, pentagon, hexagon, octagon, heart, teardrop, crescent, clover, or abstract design.

4. The assembly of claim 1, wherein the hoop member is shaped differently than the cover.

5. The assembly of claim 1, wherein the cover front face, rear face, or both comprises one or more of the following: sports team logos, sports team colors, words, drawings, or enhancements.

6. The assembly of claim 1, wherein the opening is defined by a peripheral edge of the cover front and rear faces.

7. The assembly of claim 1, wherein the cover is constructed from fabric or plastic.

8. The assembly of claim 1, wherein the cover is constructed from a stretchable material.

9. The assembly of claim 1, wherein the opening is smaller in diameter than the size of the hoop member.

* * * * *